US012492617B2

(12) United States Patent
Grove et al.

(10) Patent No.: US 12,492,617 B2
(45) Date of Patent: Dec. 9, 2025

(54) PERFORATING GUN ASSEMBLY WITH REDUCED SHOCK TRANSMISSION

(71) Applicant: Halliburton Energy Services, Inc., Houston, TX (US)

(72) Inventors: Brenden Grove, Mansfield, TX (US); Courtney Ann Thain Roberts, Crowley, TX (US); Jason Karl Cook, Crowley, TX (US); Christopher C Hoelscher, Arlington, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 12 days.

(21) Appl. No.: 17/079,601

(22) Filed: Oct. 26, 2020

(65) Prior Publication Data

US 2022/0127935 A1 Apr. 28, 2022

(51) Int. Cl.

| | |
|---|---|
| ***E21B 43/117*** | (2006.01) |
| ***E21B 43/116*** | (2006.01) |
| ***E21B 43/119*** | (2006.01) |

(52) U.S. Cl.

CPC ..... *E21B 43/117* (2013.01); *E21B 43/116* (2013.01); *E21B 43/119* (2013.01)

(58) Field of Classification Search

CPC ... E21B 43/117; E21B 43/119; E21B 43/1195
See application file for complete search history.

(56) References Cited

U.S. PATENT DOCUMENTS

| | | | | |
|---|---|---|---|---|
| 4,598,776 | A * | 7/1986 | Stout | E21B 43/117 175/4.54 |
| 5,117,911 | A | 6/1992 | Navarette | |
| 5,131,470 | A | 7/1992 | Miszewski | |
| 6,253,856 | B1 | 7/2001 | Ingram | |
| 7,770,662 | B2 | 8/2010 | Harvey | |
| 8,726,809 | B2 | 5/2014 | Walton | |
| 9,080,433 | B2 * | 7/2015 | Lanclos | F42D 1/05 |
| 9,157,718 | B2 | 10/2015 | Ross | |
| 9,677,347 | B2 | 6/2017 | Ash | |
| 10,060,234 | B2 | 8/2018 | Robey | |

(Continued)

FOREIGN PATENT DOCUMENTS

| | | |
|---|---|---|
| GB | 2398092 A8 | 8/2004 |
| GB | 2398093 B | 9/2004 |

(Continued)

OTHER PUBLICATIONS

Qiao Deng, Study of downhold shock loads for ultra-deep well perforation and optimization measures, Jun. 2019.

(Continued)

*Primary Examiner* — Yong-Suk (Philip) Ro
(74) *Attorney, Agent, or Firm* — K&L Gates LLP

(57) ABSTRACT

A method and systems for perforating a formation surrounding a borehole that include placing a perforating gun assembly into the borehole, the perforating gun assembly including a gun body comprising a connector and a shaped charge within the gun body. The shaped charges are detonated, thereby producing a shock wave in the gun body. The shock wave propagating through the gun body is attenuated using a shock attenuation feature in the gun body to decrease a stress from the shock wave communicated to the connector.

14 Claims, 8 Drawing Sheets

(56) References Cited

U.S. PATENT DOCUMENTS

| | | | | |
|---|---|---|---|---|
| 10,098,563 | B2 * | 10/2018 | Kimura | A61B 5/489 |
| 10,246,975 | B2 | 4/2019 | Spring | |
| 10,677,026 | B2 * | 6/2020 | Sokolove | E21B 43/117 |
| 2009/0151589 | A1 | 6/2009 | Henderson | |
| 2012/0152615 | A1 | 6/2012 | Rodgers et al. | |
| 2012/0247769 | A1 * | 10/2012 | Schacherer | E21B 43/117 166/63 |
| 2013/0048376 | A1 | 2/2013 | Rodgers et al. | |
| 2013/0213668 | A1 * | 8/2013 | Hales | E21B 43/11 166/55 |
| 2017/0028437 | A1 * | 2/2017 | Holly | E21B 43/116 |
| 2017/0145798 | A1 * | 5/2017 | Robey | E21B 43/117 |
| 2018/0299239 | A1 * | 10/2018 | Eitschberger | F42D 1/045 |
| 2019/0234188 | A1 * | 8/2019 | Goyeneche | E21B 43/117 |
| 2020/0088013 | A1 | 3/2020 | Grove | |
| 2020/0270954 | A1 * | 8/2020 | Borgfeld | E21B 47/017 |

FOREIGN PATENT DOCUMENTS

| | | | |
|---|---|---|---|
| GB | 2398094 | B | 9/2004 |
| WO | 2008063979 | A1 | 5/2008 |
| WO | 2016094753 | A1 | 6/2016 |

OTHER PUBLICATIONS

International Search Report and Written Opinion dated Jul. 22, 2021 for PCT Patent Application No. PCT/US2020/057345 filed on Oct. 26, 2020.

* cited by examiner

PERFORATING GUN ASSEMBLY WITH REDUCED SHOCK TRANSMISSION

BACKGROUND

This section is intended to provide relevant background information to facilitate a better understanding of the various aspects of the described embodiments. Accordingly, these statements are to be read in this light and not as admissions of prior art.

After drilling the various sections of a subterranean bore that traverses a formation, individual lengths of metal tubulars are typically secured together to form a casing string that is positioned within the borehole. This casing string increases the integrity of the borehole and provides a path for producing fluids from the producing intervals to flow into a production tubing and then to the surface. Conventionally, the casing string is cemented within the borehole. To produce fluids into the casing string, hydraulic openings or perforations must be made through the casing string, the cement sheath, and into the formation surrounding the borehole.

Typically, these perforations are created by a perforating gun. The perforating gun includes a series of shaped charges that may be held in a hollow carrier, or gun body. Alternatively, the perforating gun may be an exposed—or "capsule charge" system where the shaped charges are open the borehole environment. The perforating gun is connected along a tool string that is lowered into the cased borehole by a tubing string, wireline, slick line, coiled tubing, or other conveyance. More than one perforating gun may be also attached to each other on the conveyance. Once the perforating gun is properly positioned in the borehole adjacent to the formation to be perforated, the shaped charges may be detonated, thereby creating perforations through the gun body and the desired hydraulic openings through the casing and cement sheath into the formation. Detonating the shaped charges creates shock waves that propagate through the gun body and travel to adjacent portions through connections between the perforating gun and other perforating guns or the conveyance. Stress from the shock waves can be communicated from the gun body to adjacent components, potentially causing damage to the connections between components or rendering the connections difficult to separate post detonation.

BRIEF DESCRIPTION OF THE DRAWINGS

Embodiments of the perforating gun assembly with reduced shock transmission are described with reference to the following figures. The same or sequentially similar numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

The present disclosure describes oilfield equipment, and in particular to downhole tools, drilling and related systems and techniques for drilling, completing, servicing, and evaluating wellbores in the earth. More particularly still, the present disclosure relates to an improvement in systems and methods for performing perforating operations by including shock attenuation features in the gun body of a perforating gun assembly located and configured to attenuate detonation shock waves to decrease stress communicated to the connector of the gun body assembly. Such attenuation allows for less robust connectors between perforating gun assemblies or the conveyance used to place the perforating gun assembly in the borehole.

Figure 1:
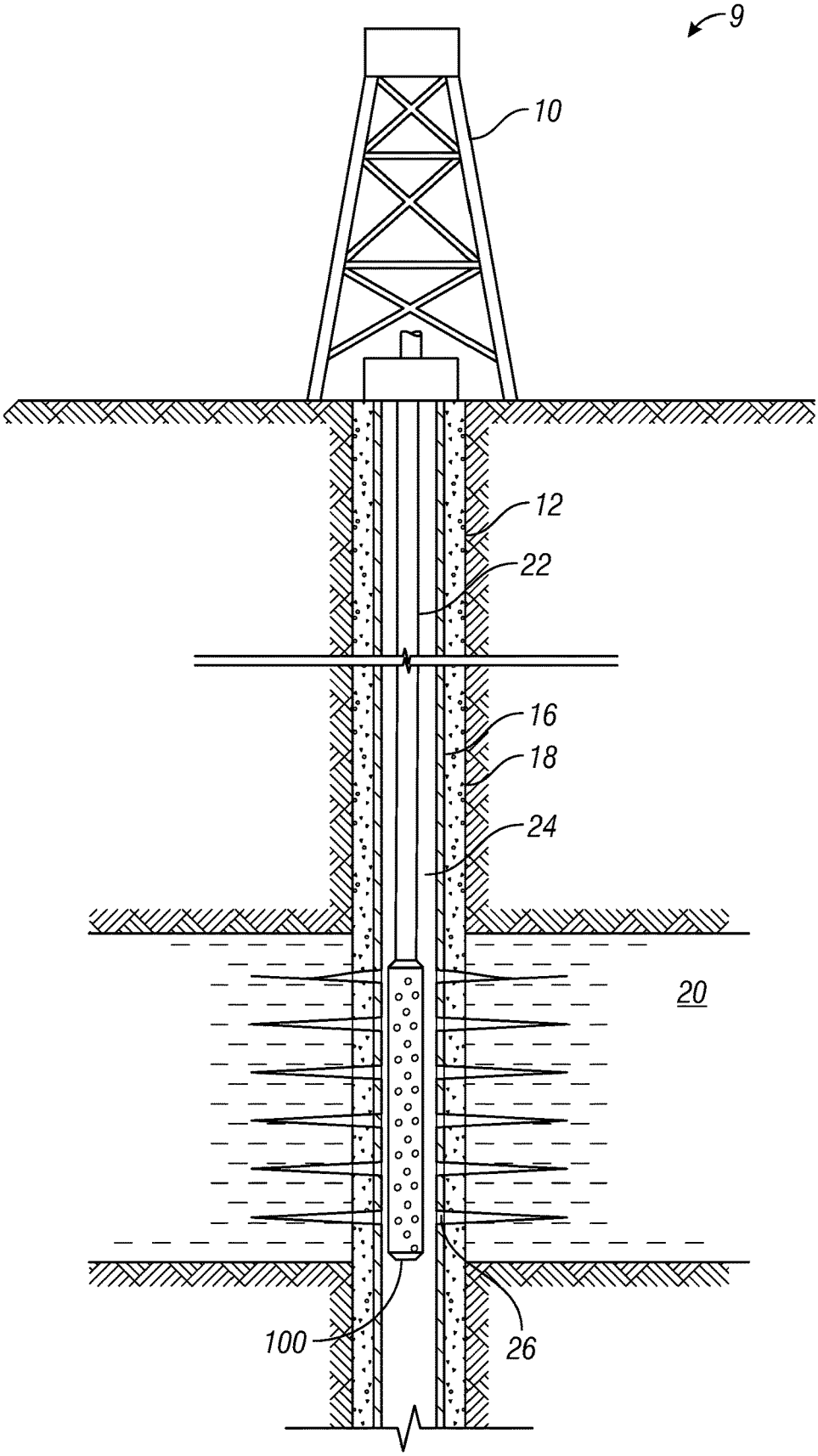
FIG. 1 is an elevation view in partial cross section of an embodiment of a perforation system with a perforating gun assembly.

FIG. 1 is an elevation view in partial cross-section of a well system, generally designated 9, according to an embodiment. The well system 9 may include drilling, completion, servicing, or workover rig 10. The rig 10 may be deployed on land or used in association with offshore platforms, semi-submersibles, drill ships and any other system satisfactory for drilling, completing, or servicing a well 12 comprising a borehole 13. The rig 10 may include a hoist, rotary table, slips, elevator, swivel, and/or top drive (not illustrated) for assembling and running a conveyance 22 from the surface. A blow out preventer, Christmas tree, and/or and other equipment associated with servicing or completing the well 12 (not illustrated) may also be provided.

The borehole 13 may extend through various earth strata into a first hydrocarbon bearing subterranean formation 20. A portion of the borehole 13 may be lined with a casing string 16, which may be joined to the formation with casing cement 18. In some embodiments, the conveyance 22 may be positioned within the borehole 13. The term conveyance, as used herein broadly encompasses any conveyance for downhole use, including drill strings, completion strings, evaluation strings, other tubular members, wireline systems, and the like. The conveyance 22 may provide an internal flow path for workover operations and the like as appropriate. An annulus 24 may be formed between the exterior of the conveyance 22 and the inside wall of the borehole 13 or the casing string 16.

According to one or more embodiments, the conveyance 22 may carry a perforating gun assembly 100. The perforating gun assembly 100 may be designed and arranged to creating openings, or perforations 26 through the casing string 16, the casing cement 18, and into the surrounding formation 20 for fluid communication between the formation 20 and the interior of the casing string 16. As described in detail hereinafter, the perforating gun assembly 100 includes a gun body that that includes shock attenuation features to attenuate shockwaves caused by detonation of a shaped charge.

Figure 2A:
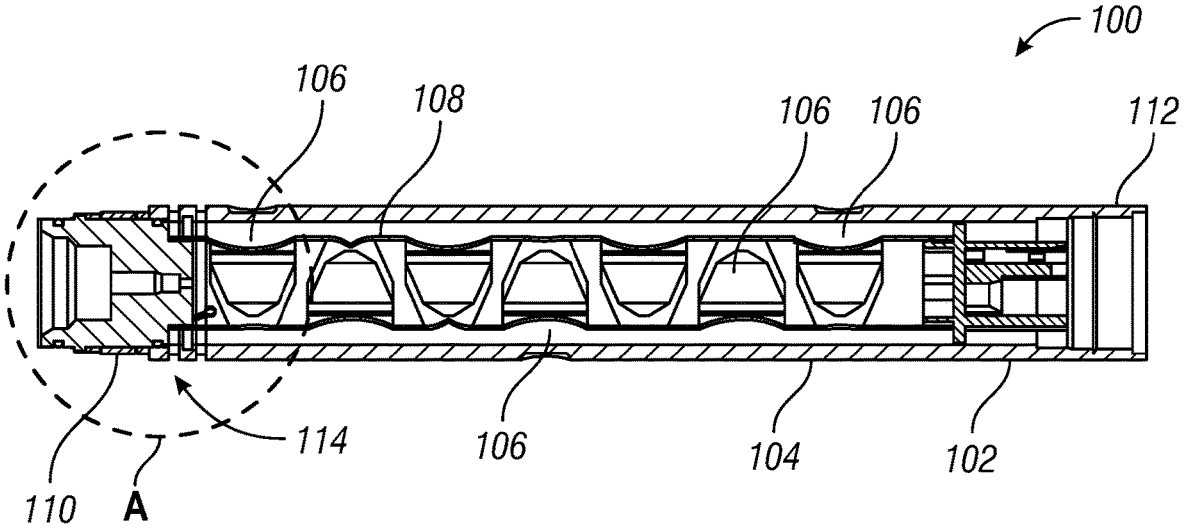
FIGS. 2A-C are side views of cross sections and partial cross sections of the perforating gun assembly of FIG. 1.
Figure 2B:
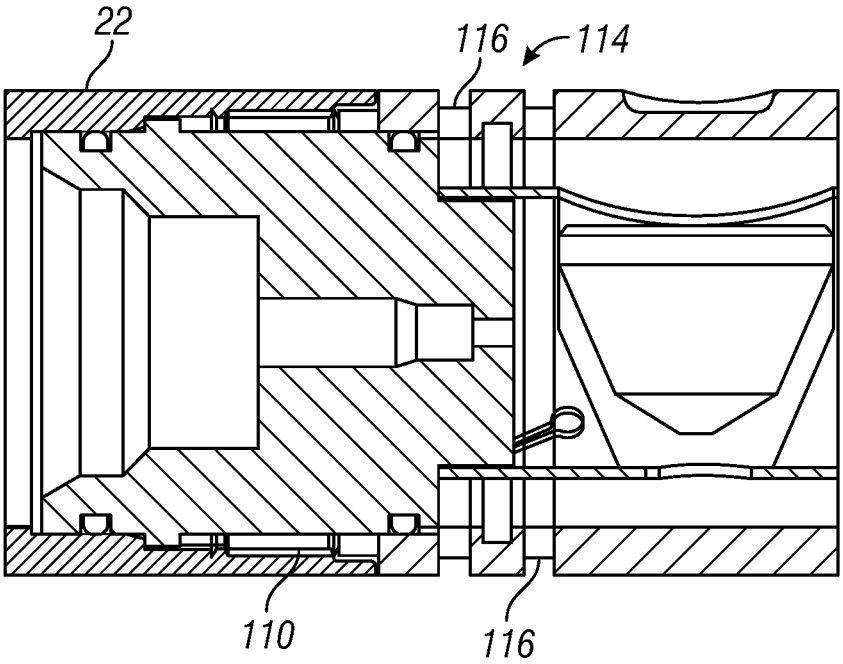
Figure 2C:
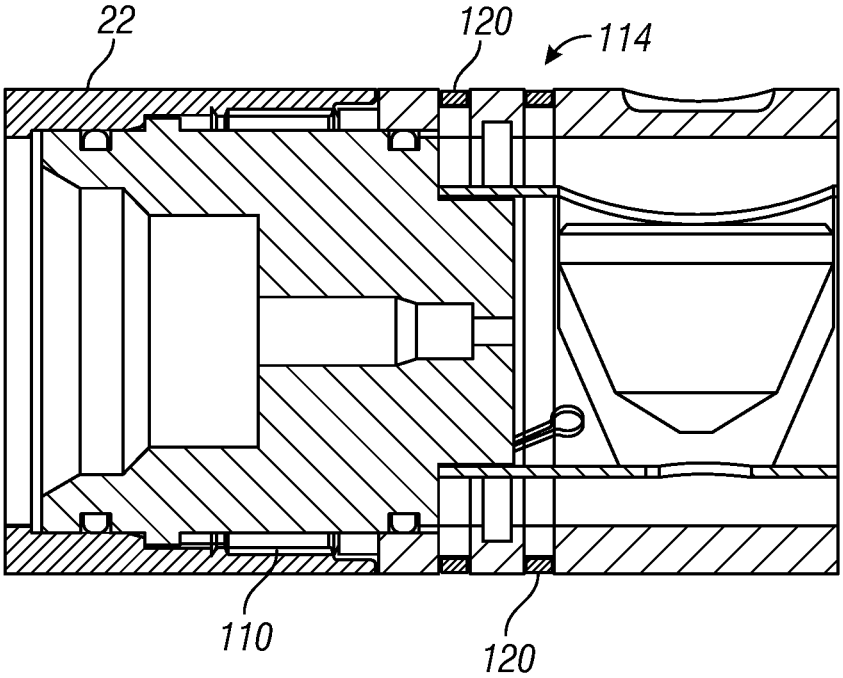

FIGS. 2A-C are side views of cross sections and partial cross sections of the perforating gun assembly 100 of FIG. 1 for use within the borehole 13. As shown, the perforating gun assembly 100 includes a gun body 102 extending from one end of the perforating gun assembly 100 to the other. The gun body 102 is a solid, generally cylindrical body with a gun body wall 104 for protecting and housing shaped charges 106. Supporting the shaped charges 106 within the gun body 102 is a shaped charge carrier 108. Also included within the gun body 102 (but not shown) are appropriate detonation cords for detonating the shaped charges 106.

As better shown in FIG. 2B, which is a zoomed portion of FIG. 2A shown by circle A, at each end of the perforating gun assembly are connectors 110, 112. The connector 110 as shown is a "pin" or "male" connector. The connector 112 as shown is a "box" or "female" connector. The pin connector 110 is used to connect the perforating gun assembly 100 to either the conveyance 22 or another perforating gun assembly in other embodiments, is a threaded connection. However, it should be appreciated that the connector 110 may be a different type of connector or a combination of threaded and some other type of connector. Within and partially extending from the connector 110 is a bulkhead 118 that provides a connection for transmitting a detonation signal from a detonation controller located at ground level to the shaped charges 106.

To help protect the connection of the connector 110, the gun body wall includes a shock attenuation feature 114. The shock attenuation feature 114 is located and configured to attenuate shock waves propagating through the gun body to decrease the stress communicated to the connector 110 caused by the shock wave from the detonation. The shock attenuation feature 114 may be any structural component in the gun body wall 104 suitable to attenuate a shock wave. For example, the shock attenuation feature 114 may be a disruption in the gun body wall 104, such as a groove or a shoulder. As shown, the shock attenuation feature 114 comprises multiple grooves 116 in the gun body wall 104 and extending circumferentially around the gun body 102. However, it should be appreciated that the shock attenuation feature 114 can also include one, two, three, or any number of grooves to attenuate the shock wave propagating through the gun body wall 104 to decrease the stress communicated to the connector 110. The grooves 116 are in the gun body wall 104 and thus the grooves 116 are less deep than the thickness of the gun body wall 104. The shock attenuation feature 114 may also include other configurations than the grooves 116 shown, as discussed in more detail below. Further, the grooves 116 are shown in the outside of the gun body wall 104, or open to the outside of the gun body 102. However, the grooves 116 may instead be on the inside of the gun body wall 104 or, when multiple grooves 116 are used, some grooves 116 may be on the inside and some on the outside.

As shown in FIG. 1, the perforation gun assembly 100 may be used by placing the perforating gun assembly 100 into the borehole 13 surrounded by the formation 20. The perforation gun assembly 100 is placed in the borehole 13 by connecting the perforation gun assembly 100 to the conveyance 22 using the connector 110 and lowering the perforation gun assembly 100 into the borehole 13 using the conveyance 22. Once the perforating gun assembly 100 is properly positioned in the borehole 13 adjacent to the formation 20 to be perforated, the shaped charges 106 may be detonated, thereby creating perforations 26 through the gun body 102 and the desired hydraulic openings through the string 16 and cement 18 into the formation 20.

Detonating the shaped charges 106 also creates shock waves that propagate through the gun body 102. The shock waves create a stress in the gun body wall 104 that may be either a tensile stress or a compressive stress. Before the shock waves reach the connector 110, the shock attenuation feature 114 attenuates the shock waves to decrease the stress communicated to the connector 110 as well as the conveyance 22. The shock attenuation feature 114 attenuates the shock waves by partially reflecting the shock waves back toward the source from which they originated, thus reducing the magnitude of the shock transmitted in the original transmission direction. In this manner, the stress communicated to the connector 110 is decreased, causing less damage to the connection between the perforation gun assembly 100 and the conveyance 22 and rendering the connections less difficult to separate post detonation. Further, decreasing the stress also allows the connector 110 to be designed as less robust or of a smaller size and yet still be able to withstand detonation from the shaped charges 106 because less stress is being communicated to the connector 110 due to the shock attenuation feature 114.

As shown in FIG. 2C, the grooves 116 may alternatively be filled in with an impedance mismatch material 120 having an impedance different from the gun body 102. The impedance of the material 120 may be either higher or lower than the impedance of the gun body 102 itself. Further, the impedance of the material 120 may also be different from the impedance of any fluid inside or outside of the perforation gun assembly 100. The material 120 may fill the entire grooves 116 as shown or fill less than the entire depth of the grooves 116. If the shock attenuation feature 114 includes more than one groove 116, the material 120 in each groove 116 may be a different material and be filled to different depths within each groove 116. The impedance material 120 may be any suitable material having the desired impedance properties for the shock attenuation feature 114. For example, the material 120 may be lead, tin, bismuth, indium, rubber, plastic, or a liquid such as water or oil-based (i.e. filled with the wellbore fluid).

Figure 3:
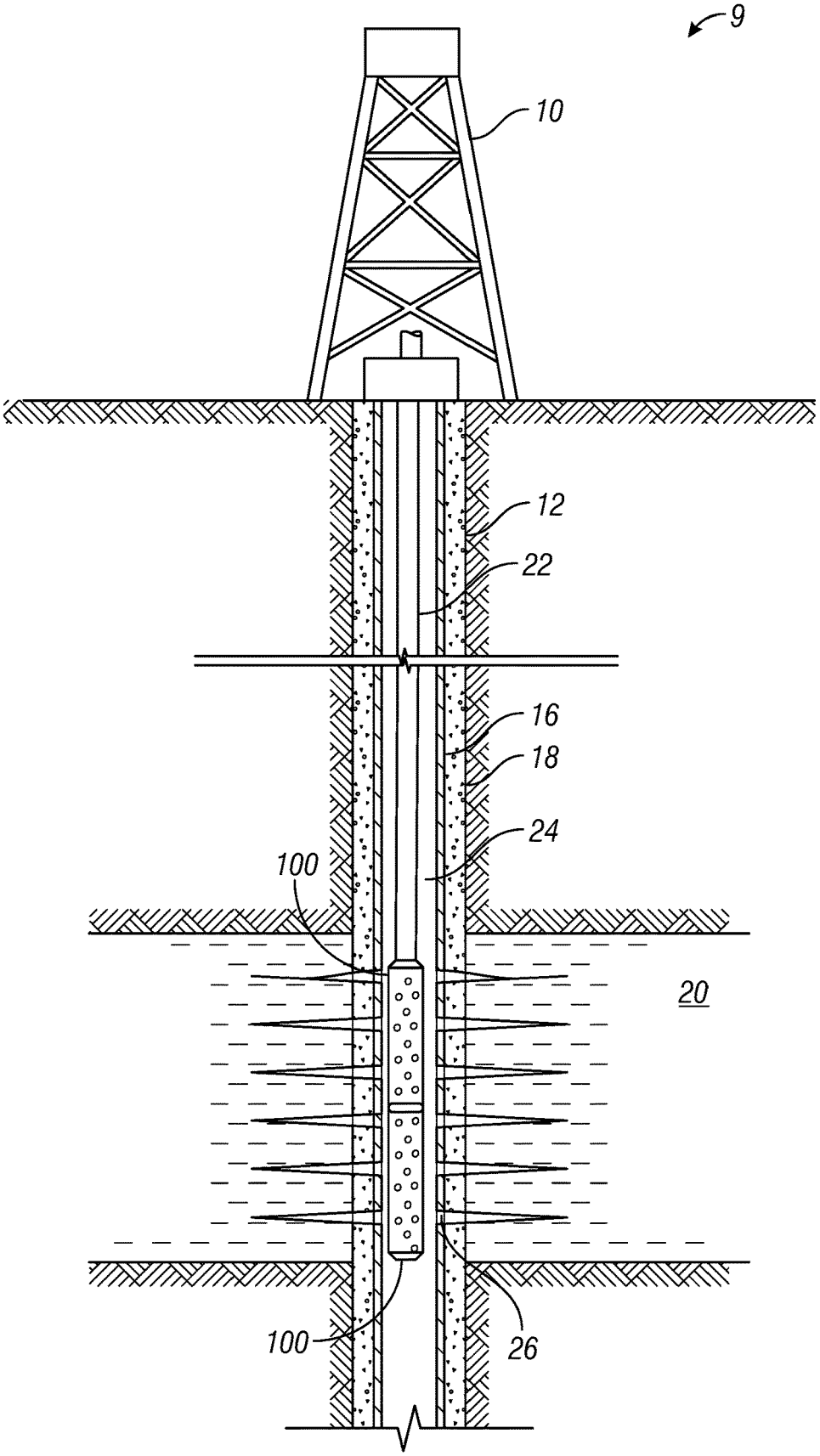
FIG. 3 is an elevation view in partial cross section of another embodiment of a perforation system with more than one perforating gun assembly.

FIG. 3 is an elevation view in partial cross-section of another embodiment of the well system 9 of FIG. 1, except that in this embodiment, the well system 9 includes multiple perforation gun assemblies 100 of FIGS. 2A-C connected with the conveyance 22. Each perforation gun assembly 100 includes a gun body 102, a connector 110, shaped charges 106, and the shock attenuation feature 114 for attenuating shock waves propagating through the respective gun bodies 102, thus decreasing the stress communicated to the connectors 110. As shown, two perforation gun assemblies 100 are connected directly to each other and one of the perforation gun assemblies 100 is connected to the conveyance 22. However, more than two perforation gun assemblies 100 may be connected with the conveyance 22. Further, the perforation gun assemblies 100 need not be connected directly with each other. Instead, other equipment may be connected between the perforation gun assemblies 100. The perforation gun assemblies 100 may also each have the same or different shock attenuation features 114, depending on the configuration of each perforation gun assembly 100.

As shown in FIG. 3, the perforation gun assemblies 100 may be used by placing the perforating gun assembly 100 into the borehole 13 surrounded by the formation 20. The perforation gun assemblies 100 are placed in the borehole 13 by connecting the perforation gun assemblies 100 together and to the conveyance 22 using the connectors 110 and lowering the perforation gun assemblies 100 into the borehole 13 using the conveyance 22. Once the perforating gun assemblies 100 are properly positioned in the borehole 13 adjacent to the formation 20 to be perforated, the shaped charges 106 of each assembly 100 may be detonated, thereby creating perforations 26 through the gun bodies 102 and the desired hydraulic openings through the string 16 and cement 18 into the formation 20.

Detonating the shaped charges 106 creates shock waves that propagate through the gun bodies 102. The shock waves create a stress in the gun body walls 104 that may be either a tensile stress or a compressive stress. Before the shock waves reach the connectors 110, the shock attenuation features 114 attenuate the shock waves to decrease the stress communicated to the connectors 110 as well as the conveyance 22. The shock attenuation feature 114 attenuates the shock waves by partially reflecting the shock waves back toward the source from which they originated, thus reducing the magnitude of the shock transmitted in the original transmission direction. In this manner, the stress communicated to the connectors 110 is decreased, causing less damage to the connection between the perforation gun assemblies 100 and the conveyance 22 and rendering the connections less difficult to separate post detonation. Further, decreasing the stress also allows the connectors 110 to be designed as less robust or of a smaller size and yet still be able to withstand detonation from the shaped charges 106 because less stress is being communicated to the connectors 110 due to the shock attenuation feature 114.

Figure 4:
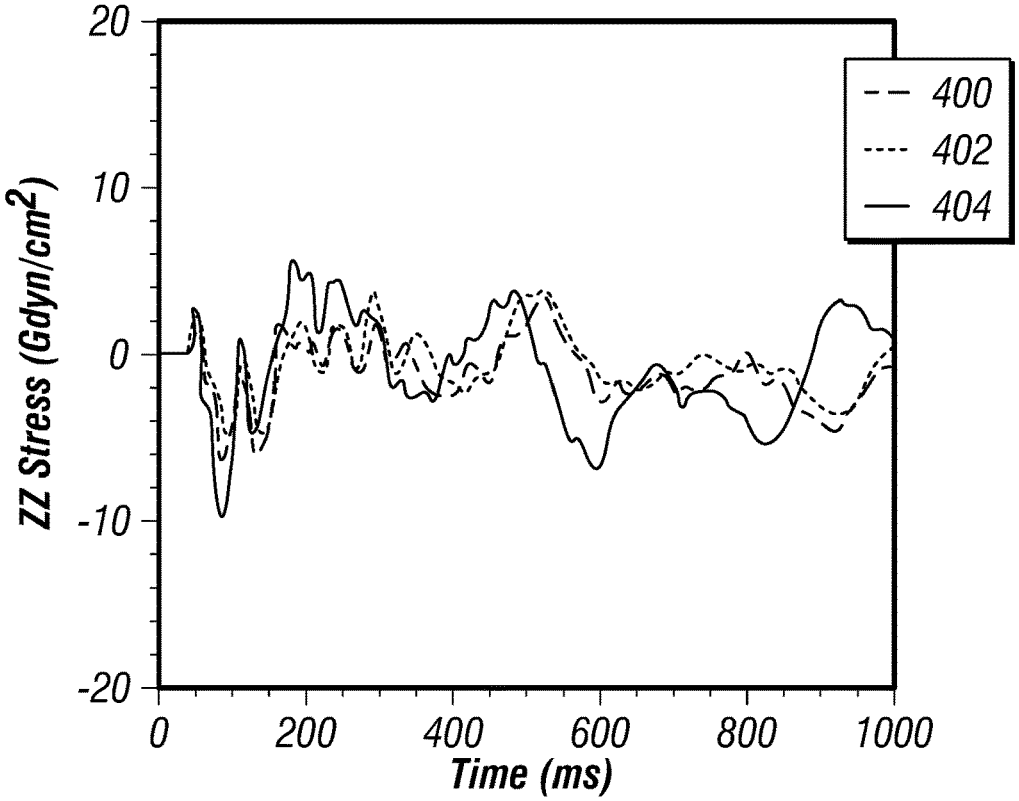
FIG. 4 is a graph showing axial stresses from detonation within different configurations of a perforating gun assembly.
Figure 5:
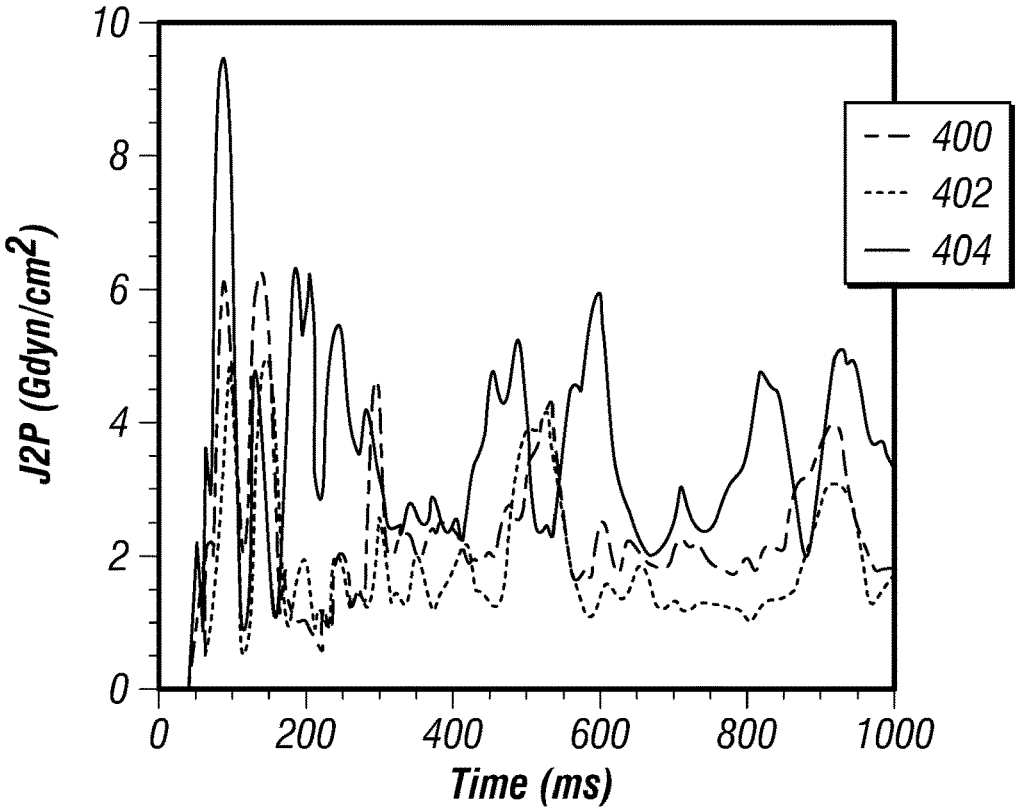
FIG. 5 is a graph showing Von Mises stresses accordingly within different configurations of a perforating gun assembly.

FIG. 4 is a graph showing simulated axial stresses in a gun body wall 104 from detonation of shaped charges 106 within a perforating gun assembly with no shock attenuation feature 114 as well as different embodiments of the perforating gun assembly 100 with the shock attenuation feature 114. FIG. 5 is a graph showing simulated Von Mises (shear) stress within a perforating gun assembly with no shock attenuation feature 114 as well as different embodiments of the perforating gun assembly 100 with the shock attenuation feature 114. The graphs in FIGS. 4 and 5 show results from computational physics simulations. In particular, the calculated stress profiles are simulated at a location in the connector, such as the connector 110, comparing 3 scenarios: (1) baseline 400 (no shock attenuation feature 114); (2) stage one 402 (shock attenuation feature 114 shown in FIG. 2B with no material 120); and (3) stage two 404 (shock attenuation feature 114 shown in FIG. 2C with material 120). In FIG. 4, negative values indicate tensile stress and positive values indicate compressive stress. FIG. 4 shows that the grooves 116 reduce the magnitude of the peak tensile stress at ~80 microseconds—in addition to many of the later-time reflections of the shockwaves produced from detonating the shaped charges 106 (comparing the baseline 400 curve vs. the stage two 404 curve). FIG. 4 also shows that filling the grooves 116 (with the material 120) can further ameliorate the stress magnitudes (comparing the stage one 402 curve vs. the baseline 400 curve). FIG. 5 shows these same stress reductions, but in the context of Von Mises (shear) stress, rather than axial stress.

Figure 6:
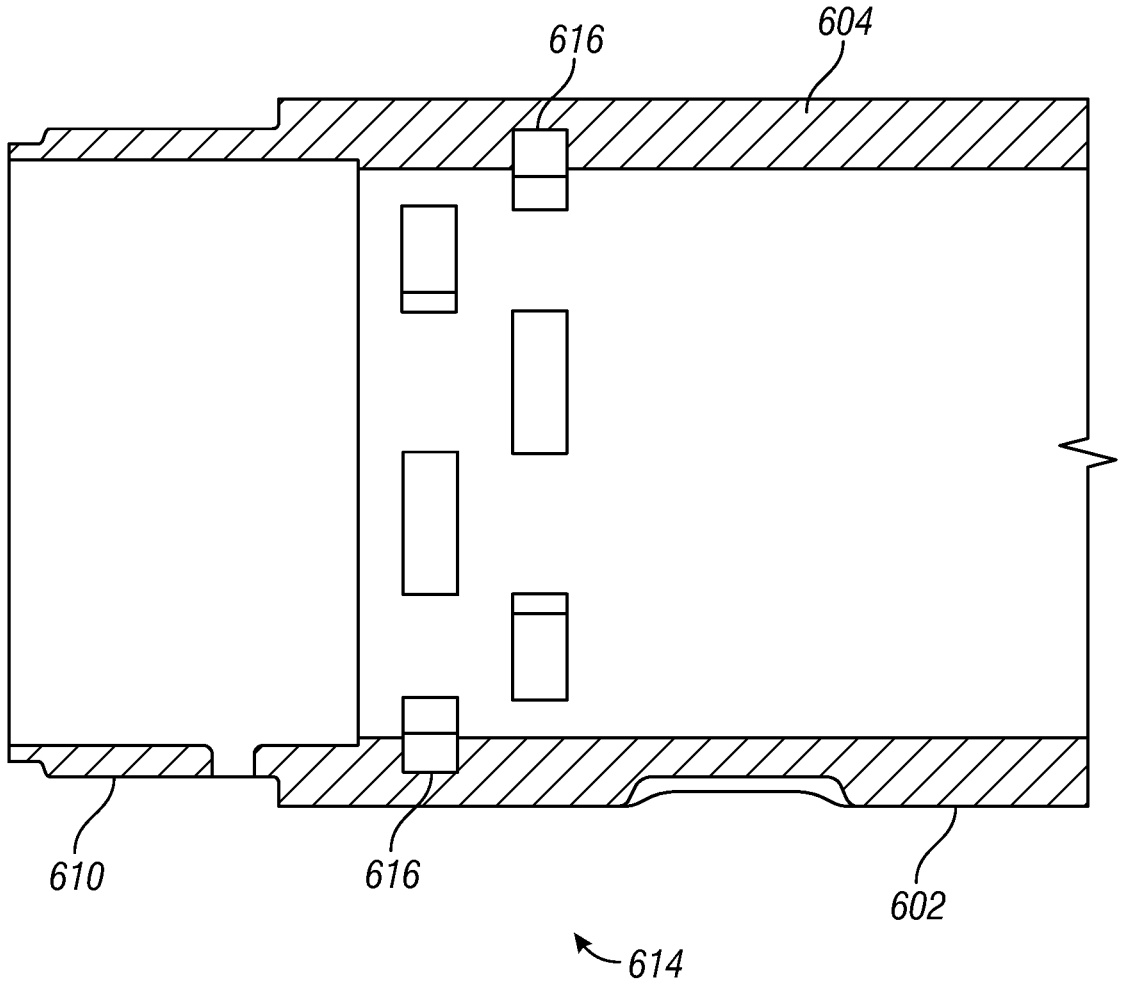
FIG. 6 is a perspective view of a cross section of another embodiment of a perforating gun assembly.

FIG. 6 is a perspective view of a cross section of another embodiment of a gun body 602 of a perforating gun assembly. The gun body 602 includes similar components as the gun body 102, the description of which will not be repeated. The view in FIG. 6 is similar to that of FIGS. 2B-C and shows a gun body 602 having a gun body wall 604 with a connector 610. The gun body wall 604 also includes a shock attenuation feature 614 with grooves 616 in the inside of the gun body wall 604 instead of the outside as shown with the gun body wall 104 of FIGS. 2A-C. Additionally, the grooves 616 do not extend circumferentially all the way around the gun body 602. Instead, the grooves 616 are segments. The segments may be arranged in a pattern, including the grooves 616 being of the same length or some that are different lengths. Additionally, with multiple grooves 616, the segments may all be aligned or instead arranged in an alternating arrangement as shown. Further, the grooves 616 may be on the outside of the gun body wall 604 or, when multiple grooves 616 are used, some grooves 616 may be on the inside and some on the outside. Additionally, multiple grooves 616 are not required and a single groove 616 not extending circumferentially around the gun body 602 may be the only component of the shock attenuation feature 614.

Figure 7:
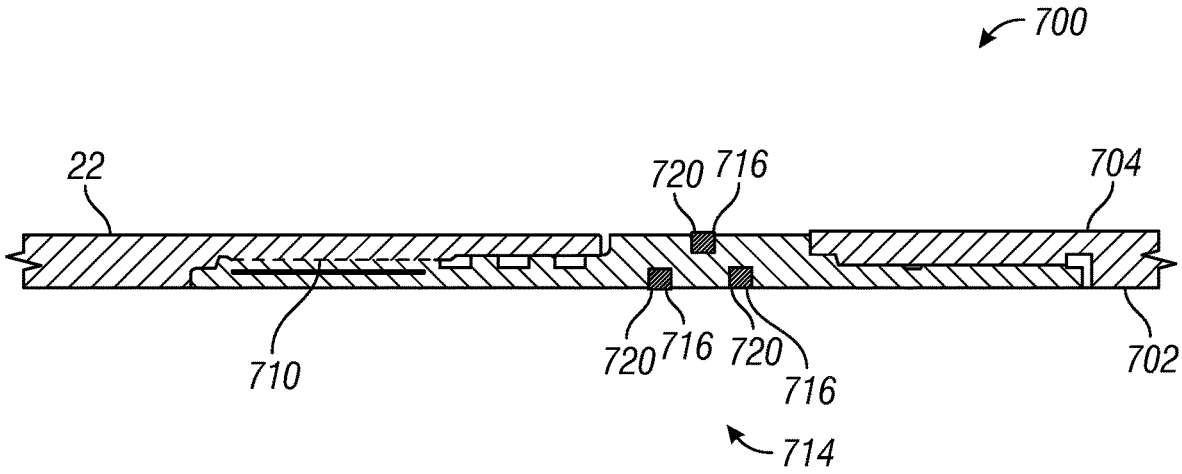
FIG. 7 is a side view of a partial cross section of another embodiment of a perforating gun assembly with an adapter.

FIG. 7 is a side view of a partial cross section of another embodiment of a perforating gun body 702 of a perforating gun assembly 700. The gun body 702 includes similar components as the gun body 102, the description of which will not be repeated. The view in FIG. 7 is similar to that of FIGS. 2B-C and shows a gun body 702 having a gun body wall 704 with a connector 710. However, the gun body 702 includes an adapter 722 to reverse the connector configuration such that the gun body 702 can connect to a box type connector on the conveyance 22 or another perforating gun assembly. The adapter 722 is an extension of the gun body wall 704, in effect making the gun body wall 704 a multi-piece body. In addition, the shock attenuation feature 714 may be located in the adapter 722 and include grooves 716. Although three grooves 716 are shown, it should be appreciated that any configuration of grooves may be used, such as those discussed in the embodiments above. Also as shown, the grooves 716 are filled with an impedance mismatch material 720. However, as noted above, the grooves 716 may also be unfilled with such material 720.

Figure 8A:
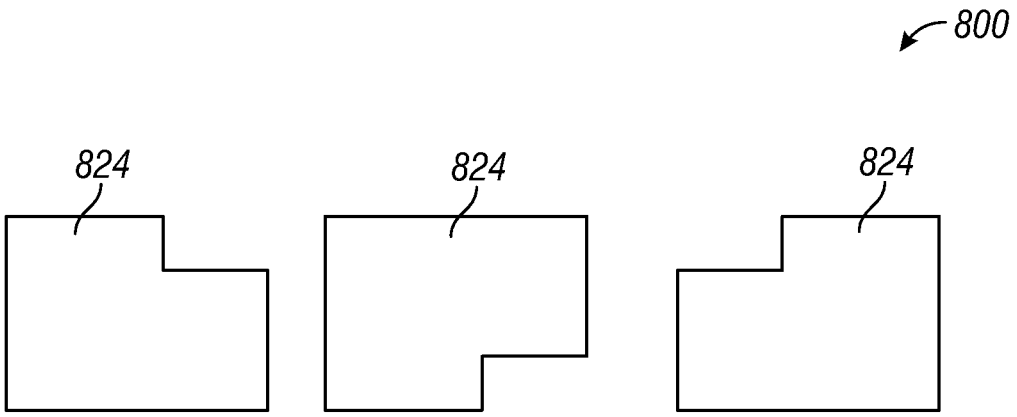
FIGS. 8A and 8B are side views of partial cross sections of another embodiment of a perforating gun assembly with the gun body including multiple sections.
Figure 8B:
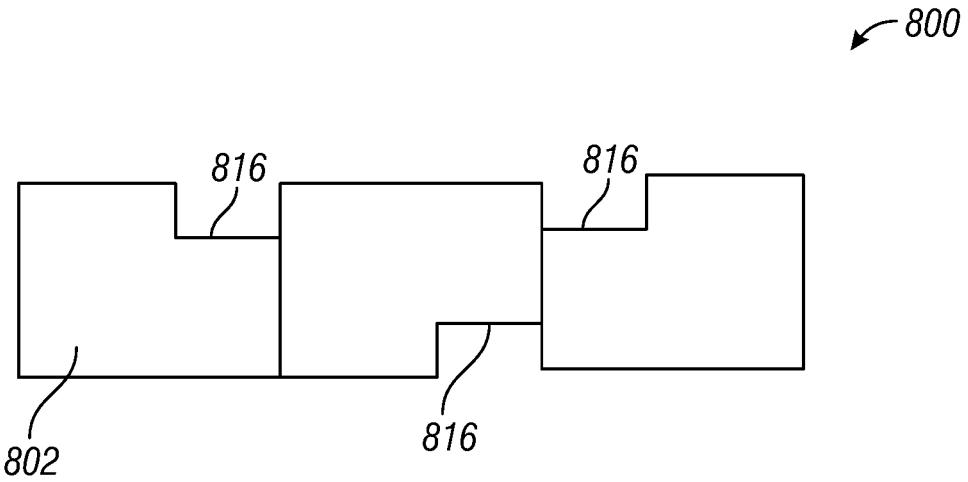

FIGS. 8A and 8B are side views of partial cross sections of another embodiment of a perforating gun body 802 of a perforating gun assembly 800 at different stages of assembly. The gun body 802 includes similar components as the gun body 102, the description of which will not be repeated. Similar to FIG. 7, the perforating gun body 802 in FIG. 8 is in multiple pieces 824 that can be combined using a suitable method or mechanism. The pieces 824 are shaped with notches such that when combined, the pieces 824 form the shock attenuation feature 814, including the grooves 816. The grooves 816 may then be filled with impedance mismatch material if desired. Further, the pieces 824 may be configured in any suitable shape to form the shock attenuation feature 814 in the desired configuration once assembled. For example, the notches may arranges such that all the grooves 816 are on the inside or outside of the gun body wall 804. Further, the grooves 816 need not extend circumferentially around the perforating gun body 802.

Examples of the above embodiments include:

Example 1 is method of perforating a formation surrounding a borehole that includes placing a perforating gun assembly into the borehole, the perforating gun assembly comprising a gun body comprising a connector and a shaped charge within the gun body. The method also includes detonating the shaped charge thereby producing a shock wave in the gun body and also attenuating the shock wave propagating through the gun body using a shock attenuation feature in the gun body to decrease a stress from the shock wave communicated to the connector.

In Example 2, the embodiments of any preceding paragraph or combination thereof further include wherein the shock attenuation feature includes a disruption in a surface of the gun body.

In Example 3, the embodiments of any preceding paragraph or combination thereof further include wherein the shock attenuation feature includes a groove in a wall of the gun body.

In Example 4, the embodiments of any preceding paragraph or combination thereof further include wherein the groove extends circumferentially around the gun body.

In Example 5, the embodiments of any preceding paragraph or combination thereof further include more than one groove.

In Example 6, the embodiments of any preceding paragraph or combination thereof further include wherein the gun body includes more than one separate piece connected together.

In Example 7, the embodiments of any preceding paragraph or combination thereof further include a material within the groove with an impedance different from the gun body.

In Example 8, the embodiments of any preceding paragraph or combination thereof further include wherein the stress from the shock wave comprises a tensile stress.

In Example 9, the embodiments of any preceding paragraph or combination thereof further include wherein placing further includes connecting another perforating gun assembly to the perforating gun assembly and attenuating further comprises decreasing the stress communicated from the other perforating gun assembly through the other perforating gun connector.

In Example 10, the embodiments of any preceding paragraph or combination thereof further include placing further includes connecting the perforating gun assembly to a conveyance using the connector and attenuating further includes decreasing the stress communicated from the perforating gun assembly to the conveyance through the connector.

In Example 11, the embodiments of any preceding paragraph or combination thereof further include wherein placing further includes connecting the perforating gun assembly to a conveyance using the connector and attenuating further comprises decreasing the stress communicated from the perforating gun assembly to the conveyance through the connector.

In Example 12, the embodiments of any preceding paragraph or combination thereof further include a perforating gun assembly for use in a borehole that includes a gun body including a shock attenuation feature and a connector. The assembly further includes a shaped charge supported within the gun body, detonation of which produces a shock wave that propagates within the gun body. The shock attenuation feature is located and configured to attenuate the shock wave within the gun body to decrease a stress communicated to the connector.

In Example 13, the embodiments of any preceding paragraph or combination thereof further include wherein the shock attenuation feature includes a disruption in a wall of the gun body.

In Example 14, the embodiments of any preceding paragraph or combination thereof further include wherein the shock attenuation feature includes a groove in a wall of the gun body.

In Example 15, the embodiments of any preceding paragraph or combination thereof further include wherein the groove extends circumferentially around the gun body.

In Example 16, the embodiments of any preceding paragraph or combination thereof further include more than one groove.

In Example 17, the embodiments of any preceding paragraph or combination thereof further include wherein the gun body includes more than one separate piece connected together.

In Example 18, the embodiments of any preceding paragraph or combination thereof further include a material within the groove with an impedance different from the gun body.

In Example 19, the embodiments of any preceding paragraph or combination thereof further include a perforation system for perforating a formation surrounding a borehole. The system includes perforating gun assemblies, where each assembly includes a gun body comprising a shock attenuation feature, a threaded connector, and a shaped charge supported within the gun body, detonation of which produces a shock wave that propagates within the gun body. The perforating gun assemblies are connected through the connectors and the shock attenuation features are located and configured to attenuate the shock waves within the gun body to decrease stress communicated from one assembly to another assembly through the connectors.

In Example 20, the embodiments of any preceding paragraph or combination thereof further include a conveyance connected to one of the perforating gun assemblies, wherein the shock attenuation feature of the perforating gun assembly connected to the conveyance is located and configured to attenuate the shock wave and decrease stress communicated to the conveyance through the connector.

Certain terms are used throughout the description and claims to refer to particular features or components. As one skilled in the art will appreciate, different persons may refer to the same feature or component by different names. This document does not intend to distinguish between components or features that differ in name but not function.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

What is claimed is:

1. A method of perforating a formation surrounding a borehole, comprising:

placing a perforating gun assembly into the borehole, the perforating gun assembly comprising a gun body comprising a gun body wall, a connector, and a shaped charge housed within the gun body wall, the gun body also comprising a longitudinal axis;

detonating the shaped charge thereby producing a shock wave in the gun body; and attenuating the shock wave propagating through the gun body wall using a shock attenuation feature in the gun body wall, wherein the shock attenuation feature is longitudinally axially positioned intermediate the shaped charge and the connector, and wherein the shock attenuation feature is longitudinally axially spaced from the connector to decrease a stress from the shock wave communicated to the connector, wherein the shock attenuation feature comprises more than one groove, each groove being located at a longitudinal axial position of the gun body wall and comprising a pattern of groove segments spaced circumferentially around the gun body wall.

2. The method of claim 1, wherein the gun body comprises more than one separate piece connected together.

3. The method of claim 1, further comprising a material within at least one of the grooves with an impedance different from the gun body wall, wherein the material is a solid.

4. The method of claim 3, wherein the at least one groove defines a depth, and wherein the material fills an entirety of the depth of the at least one groove.

5. The method of claim 1, wherein the stress from the shock wave comprises a tensile stress.

6. The method of claim 5, wherein the tensile stress comprises a peak axial tensile stress, and wherein the shock attenuation feature is configured to attenuate a simulated peak axial tensile stress of the shock wave by at least 1 $Gdyn/cm^2$.

7. The method of claim 1, wherein placing further comprises connecting a second perforating gun assembly to the perforating gun assembly and attenuating further comprises decreasing the stress communicated from the second perforating gun assembly through the second perforating gun connector.

8. The method of claim 7, wherein:

placing further comprises connecting the perforating gun assembly to a conveyance using the connector; and attenuating further comprises decreasing the stress communicated from the perforating gun assembly to the conveyance through the connector.

9. The method of claim 1, wherein placing further comprises connecting the perforating gun assembly to a conveyance using the connector and attenuating further comprises decreasing the stress communicated from the perforating gun assembly to the conveyance through the connector.

10. A perforating gun assembly for use in a borehole, comprising:

a gun body comprising a longitudinal axis and:

a gun body wall comprising a shock attenuation feature;

a connector;

a shaped charge supported within the gun body wall, detonation of which produces a shock wave that propagates within the gun body;

wherein the shock attenuation feature is longitudinally axially positioned intermediate the shaped charge and the connector, wherein the shock attenuation feature is longitudinally axially spaced from the connector and configured to attenuate the shock wave within the gun body to decrease a stress communicated to the connector, wherein the shock attenuation feature comprises more than one groove at longitudinal axial positions of the gun body wall, groove comprising a pattern of groove segments spaced circumferentially around the gun body wall.

11. The perforating gun assembly of claim 10, wherein the gun body comprises more than one separate piece connected together.

12. The perforating gun assembly of claim 10, further comprising a material within at least one of the grooves with an impedance different from the gun body wall, wherein the material is a solid.

13. A perforation system for perforating a formation surrounding a borehole, the system comprising:

perforating gun assemblies, each assembly comprising a gun body comprising a longitudinal axis and:

a gun body wall comprising a shock attenuation feature, the shock attenuation feature comprises comprising more than one groove, each groove being located at a longitudinal axial position of the gun body wall and comprising a pattern of groove segments spaced circumferentially around the gun body wall;

a threaded connector, wherein the threaded connector is longitudinally axially spaced from the shock attenuation feature; and a shaped charge supported within the gun body wall, detonation of which produces a shock wave that propagates within the gun body, wherein the shock attenuation feature is longitudinally axially positioned intermediate the shaped charge and the connector; and wherein the perforating gun assemblies are connected through the threaded connectors and each shock attenuation feature is located and configured to attenuate the shock waves within each respective gun body to decrease stress communicated from one assembly to another assembly through the threaded connectors.

14. The perforation system of claim 13, further comprising a conveyance connected to one of the perforating gun assemblies, wherein the shock attenuation feature of the perforating gun assembly connected to the conveyance is located and configured to attenuate the shock wave and decrease stress communicated to the conveyance through the connector.

* * * * *